United States Patent [19]

Kölbl et al.

[11] 4,437,557

[45] Mar. 20, 1984

[54] COIN COLLECTION FOR VENDING MACHINES

[75] Inventors: Richard Kölbl; Bernd Mehlan, both of Herrieden, Fed. Rep. of Germany

[73] Assignee: Sielaff GmbH & Co., Fed. Rep. of Germany

[21] Appl. No.: 307,294

[22] Filed: Sep. 30, 1981

[30] Foreign Application Priority Data

Oct. 8, 1980 [DE] Fed. Rep. of Germany ..... 3037996

[51] Int. Cl.[3] ..... G07F 9/00

[52] U.S. Cl. ..... 194/1 D; 194/1 K; 194/DIG. 15

[58] Field of Search ..... 194/1 C, 1 D, 1 E, 1 R, 194/1 K, 1 L, DIG. 3, DIG. 15

[56] References Cited

U.S. PATENT DOCUMENTS

| | | | |
|---|---|---|---|
| 1,948,107 | 6/1932 | Gilchrist et al. | 194/ |
| 2,957,568 | 10/1960 | Gabrielsen | 194/ |
| 4,037,701 | 7/1977 | Knickerbocker | 194/1 L |

FOREIGN PATENT DOCUMENTS

| | | | |
|---|---|---|---|
| 911341 | 5/1954 | Fed. Rep. of Germany | 194/DIG. 3 |
| 7909710 | 4/1979 | Fed. Rep. of Germany . | |
| 7908306 | 7/1979 | Fed. Rep. of Germany . | |

*Primary Examiner*—Joseph J. Rolla
*Assistant Examiner*—Kevin P. Shaver
*Attorney, Agent, or Firm*—McGlew and Tuttle

[57] ABSTRACT

In a coin collector of a vending machine including a credit indicator, a swivel plate obstructs, in its rest position a coin return channel. The plate is pivotable in one direction out of its rest position by the stroke of a coin return bolt and is operatively connected to the credit indicator for resetting the same. To ensure that upon actuation of the coin return bolt, the credit indicator is reliably reset, the plate keeps blocking the coin return channel during a first partial stroke of the coin return bolt, and resets the credit indicator. During a subsequent second partial stroke, the plate swivels into the coin return channel.

10 Claims, 3 Drawing Figures

COIN COLLECTION FOR VENDING MACHINES

FIELD AND BACKGROUND OF THE INVENTION

The present invention relates in general to vending machines and in particular to a new and useful device for collecting coins deposited in a vending machine.

A coin collector of this kind is described in German utility model No. 7,909,710. In this device, a swivel plate in its rest position obstructs both a return channel and a collecting channel for coins deposited in the machine. The coins recorded by a credit indicator, fall on the swivel plate. The space above the plate is sufficiently large to receive a greater number of coins. As soon as the buyer has inserted coins corresponding to the purchase price, which is registered by the credit indicator, and actuates a respective lever of the vending machine, the commodity is released and the plate swivels into a position such that the coins fall into the collecting channel.

Should the user of the machine wish, prior to removing the merchandise, to recover the already inserted coins, he or she must actuate the return lever. This lever is connected to the swivel plate which is thereby pivoted so that the coins supported thereon pass into the coin return channel. At the same time, the pivoting of the swivel plate causes resetting of the credit indicator through a coupling mechanism. In order to prevent a return of the coins before the credit indicator is reset, a reversal lock is provided by the above cited reference. This reversal lock of the reference may be disadvantageous in that sometimes, upon actuating the coin return lever only briefly, the coins inserted later always pass to the return, without the buyer noticing it as a malfunction. Further, with a failure of the reversal lock, it cannot be insured that the inserted coins are not returned prior to resetting the credit indicator.

SUMMARY OF THE INVENTION

The present invention is directed to a mechanical equipment of a coin collector of the above-mentioned kind, which however, insures that upon an actuation of the coin return lever or bolt, the credit indicator is securely reset prior to the return of the coins, without the necessity of providing a reversal lock for the return bolt.

Accordingly, an object of the invention is to provide a coin collector for a vending machine including a credit indicator, which comprises a swivel plate which, in its rest position, obscures a coin return channel. The swivel plate is pivotable in one direction out of its rest position by the stroke of a coin return bolt. The plate is coupled to the credit indicator for resetting the credit indicator. During a first partial stroke of the coin return bolt, the swivel plate continues to obstruct the coin return channel but resets the credit indicator. Only during a subsequent second partial stroke of the coin return bolt is the swivel plate pivoted into a position away from the coin return channel to permit the coins to be returned. In this way, the coins are returned only after the credit indicator has been reset to zero.

This makes sure that at the start of the coin return bolt actuation, initially the credit indicator is reset without simultaneously returning the coins. Only upon a further motion of the coin return bolt, the swivel plate is so pivoted that the coins supported thereon slide into the coin return channel. This eliminates the necessity of providing a reversal lock for the return bolt or the swivel plate, so that while operating the vending machine, the buyer is not confused by the necessity of partly actuating the return bolt, due to the lock. On the other hand, it is insured that the coins pass to the return only after the credit indicator has been reset.

Another object of the invention is to provide the swivel plate with an edge which slides along a wall surface adjoining the return channel during the entire first part of the coin return bolt stroke, to block the return channel for this first portion of the stroke.

In a preferred embodiment it is provided that the swivel plate comprises a hinge portion which applies against a stop during the first partial stroke, and is folded by the stop during the second part of the stroke. This makes it possible to provide a sufficiently large return channel entrance enabling even coins which may repose on the swivel plate in upright position to pass therethrough without jamming.

It is another object of the invention to provide a coin collector which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings in which a preferred embodiment of the invention is illustrated.

DESCRIPTION OF THE PREFERRED EMBODIMENT

Figure 1:
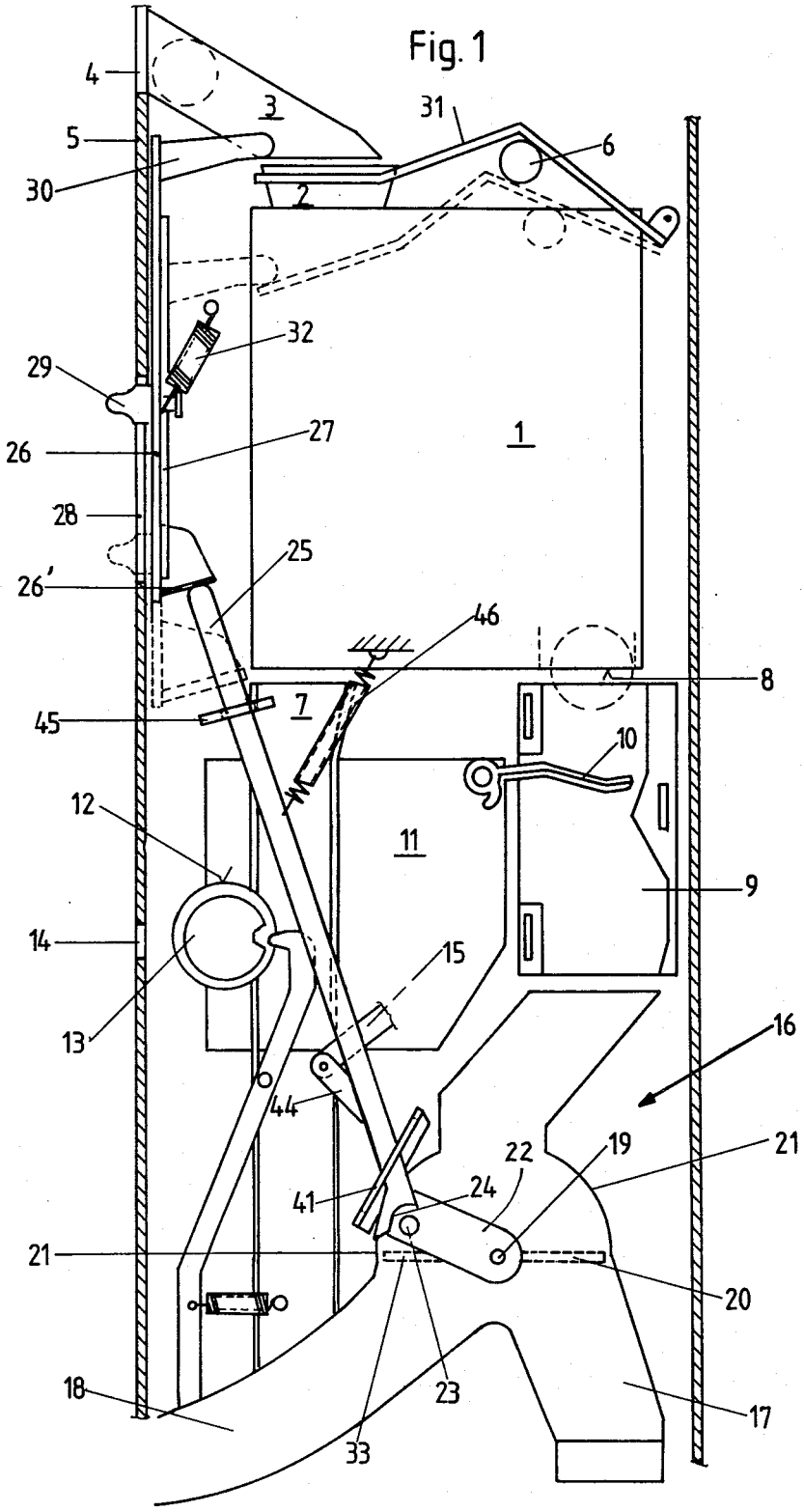
FIG. 1 is a side view of the interior of a vending machine including a credit indicator.

Turning the drawings in particular, the invention embodied therein comprises a coin collector for a vending machine which insures the resetting of a credit indicator before any coins are returned to the depositor.

A vending machine in which the merchandise dispensing elements are push buttons or drawers, for example, (not shown), comprises a coin acceptor 1. An entrance funnel 2 of acceptor 1 connects, through an entrance passage 3, to a slot 4 in the front panel 5 of the vending machine. Coin acceptor 1 is equipped with a pin 6. If pin 6 is pivoted, the acceptor opens. Any coins received on the acceptor 1, in upright position, fall into a channel 7 for incorrect money. Acceptor 1 further has at least one exit slot 8.

A corresponding number of coin chambers 9 adjoins exit slot or slots 8. An indexing lever 10 of a credit indicator 11 pivotable by a coin, projects into each of chambers 9. Every pivotal motion of lever 10 indexes an indicator roller 12 and cam plates 13 through an angle corresponding to the respective value of the coin. The instantaneous count of indicator roller 12 can be read through a window 14 in front panel 5. Cam plates 13 are manually rotatable relative to indicator roller 12. They are adjusted to a selling price by corresponding turning. Credit indicator 11 includes a reset lever 15 by which indicator roller 12 and cam plate 13 can be brought back into their zero positions. Such coin counters are known as mechanical credit indicators, for example, from German utility model No. 79 08 306. In these devices, the reset lever 15 is used, at the same time, for tensioning one or more springs, thus furnishing the necessary energy for driving the credit indicator.

Figure 2:
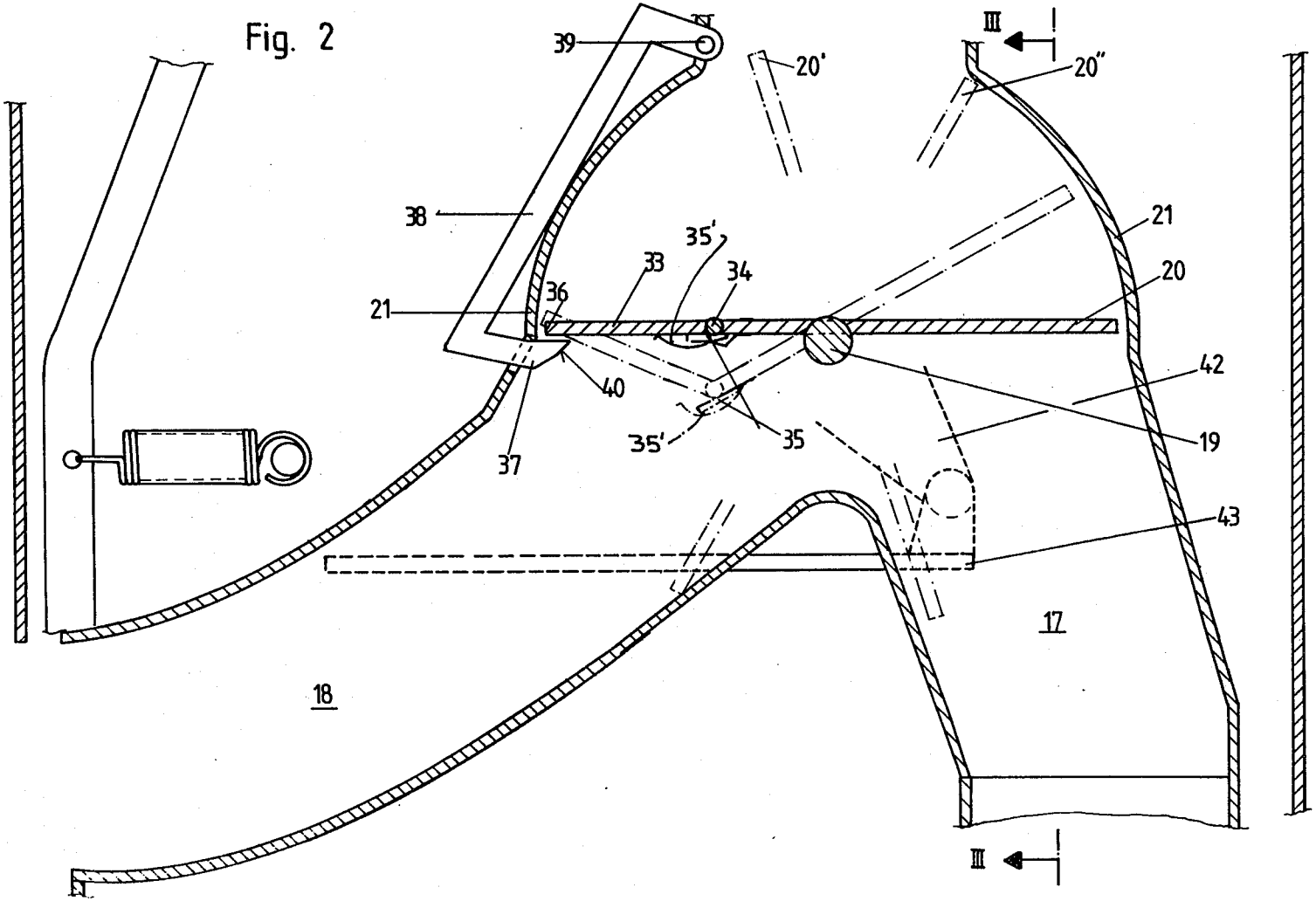
FIG. 2 is a side view of the coin collector according to the invention.
Figure 3:
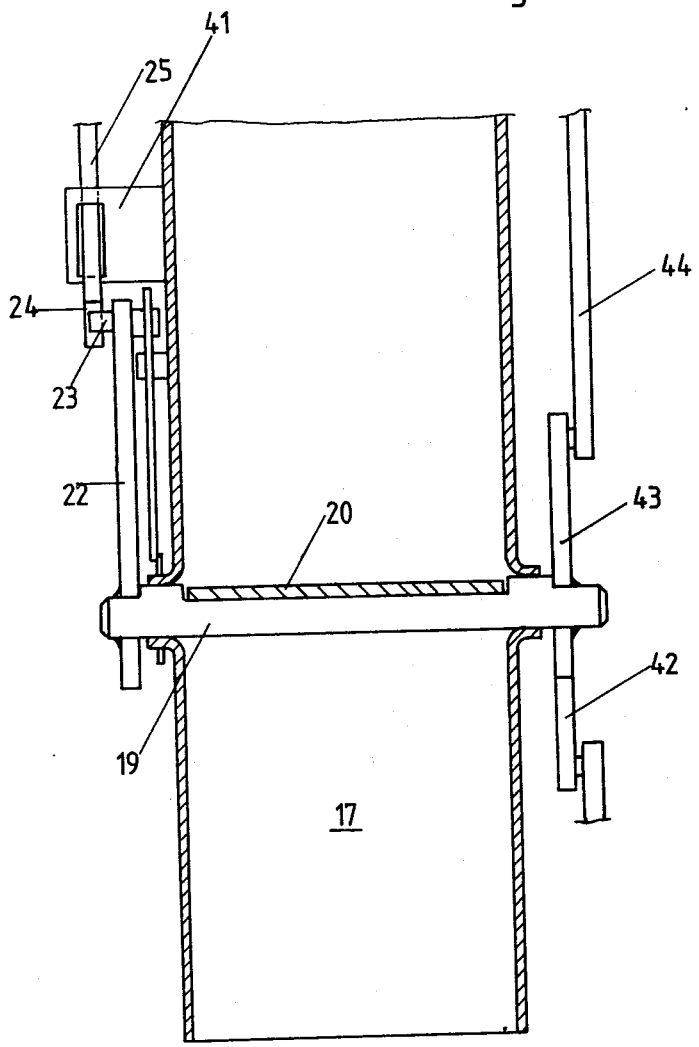
FIG. 3 is a view taken along the line III—III of FIG. 2.

Coin chamber 9 is followed by a collector 16 opening into a collector channel 17 on the one hand, and into a coin return channel 18 on the other hand. Below coin chamber or chamber 9, between collector channel 17 and coin return channel 18, a shaft 19 is mounted for supporting a swivel plate 20. The wall 21 of collector 16 above plate 20 is circularly arcuate, so that the respective edge of plate 20 can snugly follow the wall surface (see FIG. 2). The space above swivel plate 20 is large enough to easily accommodate a plurality of coins temporarily placed on plate 20. In FIG. 2, the rest position of swivel plate 20 is shown in solid lines. The collecting position of plate 20 is indicated at 20' and the coin return position at 20". In its rest position, plate 20 obstructs both collector channel 17 and return channel 18. All the coins detected and registered by the credit indicator 11 initially fall on swivel plate 20 where they accumulate without getting jammed. If the coins are directed into coin chambers 9 and assorted according to values (DM1, DM2, DM5), partitions may be provided on swivel plate 20. This provides a separate channel for each sort of coin.

One end of shaft 19 carries an eccentric 22 having a pin 23 secured to its free end. In the rest position of swivel plate 20, pin 23 opposes a stop edge 24 of a connecting rod 25.

Connecting rod 25 applies against an angle 26' of a shifting plate 26 which extends between guide rails 27 at the inside of front panel 5. Connecting rod 25 is passed through slots of a lower guide 41 and an upper guide 45 and is held in place by a spring 46. The slot of lower guide 41 gives some freedom of lateral motion to the lower end of connecting rod 25.

Shifting plate 26 is displaceable by means of a coin return bolt 29 protruding through a slot 28 which is provided in front panel 5. The length of shifting plate 26 is more than twice the length of slot 28 so that in any shifting position, plate 26 covers slot 28 from the inside. An arm 30 is secured to the upper end of shifting plate 26 which is associated with a pivoting lever 31 engaging over pin 6 of coin acceptor 1. By means of a tension spring 32, shifting plate 26 is pulled into its upper position.

Swivel plate 20 comprises a hinged portion 33 which is foldable relative to the main portion of plate 20 about a hinge 34. A supporting element 35 bridging the hinge is secured either to the main portion (as shown) or the hinged portion 33 of plate 20 and engages the respective other portion from below.

In the rest position of swivel plate 20, the edge 36 remote from hinge 34 of hinge portion 33, applies against a stop 37 provided on a lever 38. Lever 38 is pivoted at 39. Stop 37 is provided with an inclined guide face 40.

Upon actuating coin return bolt 29, swivel 20 with hinged portion 33 operates substantially as follows.

With plate 20 in its rest position, upon pushing bolt 29 downwardly, connecting rod 25 is displaced downwardly. The freedom of lateral motion necessary therefor is provided by slot guide 41. Stop edge 24 of connecting rod 25 butts up against pin 23 of eccentric 22. Shaft 19, and thus plate 20 are thereby caused to swivel in the direction of their position 20", or counterclockwise as seen in FIG. 2).

During a first partial displacement of coin return bolt 29, or stroke of rod 25, hinged portion 33 folds relative to the main portion of plate 20, with edge 36 remote from hinge 34 being backed by step 37. The two portions of plate 20 then occupy the position shown in dash-dotted lines in FIG. 2. In this position, the coins having dropped in collector 16 remain on swivel plate 20 and do not fall into return channel 18. During this first partial stroke, reset lever 15 is actuated through shaft 19, as described hereinafter.

The coins remain on swivel plate 20 until, during the second partial stroke or displacement of coin return bolt 29, edge 36 remote from hinge 34 of portion 33 slips off stop 37. As soon as hinged portion 33 slips off stop 37, the coins supported on swivel plate 20 or hinged portion 33 thereof drop into coin return channel 18. As is evident, the predominant length of displacement of coin return bolt 29 is utilized for the first partial stroke available for resetting credit indicator 11, still without initiating any return of coins. Then, at the end of the first partial stroke, the return of coins is effected substantially instantly. That is, as edge 36 of hinged portion 33 slips off stop 37, instantly a large cross-sectional area of entrance opens, through which the coins can pass into return channel 18.

Wall 21 near edge 36 of hinged portion 33 may also be shaped so that edge 36 stays adjacent the wall during the entire first portion of the full bolt stroke, thus keeping an inlet of channel 18 closed.

As swivel plate 20 or its hinged portion 33 are returned into their rest positions, portion 33 applies against inclined face 40 of lever 38 to pivot the lever outwardly about axis 39, until portion 33 slips back over stop 37. In the shown embodiment (FIG. 2), lever 38 then pivots back under its own weight, to engage portion 33 from below. A spring may be provided for returning lever 38 into its initial position. If stop 37 is fixed to collector 16 rigidly, supporting element 35 is designed as a spring element 35' which supports portion 33 in alignment with the rest of plate 20, in the rest position, but allows some reverse pivoting of hinge 34 so that edge 36 can clear stop 37.

Another eccentric 42 is secured to the end of shaft 19 opposite eccentric 22. By means of eccentric 42, swivel plate 20 is brought, in a manner known per se, upon actuating a dispensor mechanism and inserting the coins, into its collecting position 20' (plate 20 rotates clockwise in FIG. 2) in which the coins pass into collector channel 17.

Shaft 19 further carries a third eccentric 43. With a drive rod 44 pivoted thereto and having its free end, remote from the eccentric, hinged to reset lever 15, this eccentric 43 forms a linkage which, with plate 20 in rest position, is in dead center position. Therefore, turning of shaft 19 in the clockwise or counterclockwise direction causes such motion of reset lever 15 that credit indicator 11 is reset to zero and wound up at the same time.

While pivoting plate 20 in the direction of its collecting position, pin 23 of eccentric 22 moves in the clockwise direction (see FIG. 1) up to a position outside the path of motion of connecting rod 25 which is possible upon actuating coin return bolt 29. The stop edge 24 of connecting rod 25 is dimensioned correspondingly. This is advantageous since the possibility is thereby eliminated of producing an effect on collector 16 during the collecting operation by forcibly actuating coin return bolt 29.

Numerous further embodiments are covered by the scope of the invention. The invention may advantageously be applied also in designs where separate swivel plates are employed in the collector for returning and collecting coins.

The most suitable position of hinge 34 between shaft 19 and the remote edge 36 of portion 33 can easily be determined. Preferably, hinge 34 is provided somewhat closer to shaft 19 than to edge 36.

While a specific embodiment of the invention has been shown and described in detail to illustrate the application of the principles of the invention, it will be understood that the invention may be embodied otherwise without departing from such principles.

What is claimed is:

1. A coin collector for a vending machine having a credit indicator with a reset member movable to reset the credit indicator and a coin return bolt movable through a full stroke, comprising:

means defining a coin return channel having an inlet for receiving at least one coin;

a swivel plate pivotally mounted over said inlet having a rest position obstructing a passage of the coins to said return channel and a coin release position for opening said inlet;

means connecting said swivel plate to the return bolt for transmitting motion of the return bolt to said swivel plate;

means connecting said swivel plate to the reset member for moving the reset member with movement of said swivel plate out of its rest position;

position control means associated with said swivel plate for obstructing said inlet during a first portion of the full stroke of movement of the return bolt as said swivel plate is moved out of its rest position to move the reset member to reset the credit indicator and for orienting said swivel plate into its coin release position with movement of the return bolt through a remaining portion of its full stroke;

said means defining a coin return channel comprising a wall defining an arcuate upper space above said swivel plate, said swivel plate connected to a shaft rotatably mounted to said wall, said swivel plate having opposite edges each movable adjacent and along said wall in said arcuate space;

said swivel plate including a hinged portion rotatably mounted to a remainder of said swivel plate over said coin return channel inlet and spaced from said shaft, a support element connected to a bottom surface of said swivel plate to support said hinged portion, a stop lever rotatably mounted to said wall having a stop surface engaged with said hinged portion during said first portion of the full stroke of the bolt and released from said stop face during said remainder of the full stroke, said stop lever having a lower inclined surface engageable by said hinged portion during movement of said swivel plate from its coin release position back to its rest position.

2. A coin collector for a vending machine having a credit indicator with a reset member movable to reset the credit indicator and a coin return bolt movable through a full stroke, comprising:

means defining a coin return channel having an inlet for receiving at least one coin;

a swivel plate pivotally mounted over said inlet having a rest position obstructing the passage of the coins to said return channel and a coin release position for opening said inlet;

means connecting said swivel plate to the return bolt for transmitting motion of the return bolt to said swivel plate;

means connecting said swivel plate to the reset member for moving the reset member with movement of said swivel plate out of its rest position;

position control means associated with said swivel plate for obstructing said inlet during a first portion of the full stroke of movement of the return bolt as said swivel plate is moved out of its rest position to move the reset member to reset the credit indicator and for orienting said swivel plate into its coin release position with movement of the return bolt through a remaining portion of its full stroke;

said position control means comprising said swivel plate including a hinge portion, a stop member connected to said return channel defining means for supporting said hinged portion during said first portion of the full stroke of the bolt and positioned to release said hinge portion as said hinged portion pivots with respect to a remainder of said swivel plate during said remainder of the full stroke of the bolt.

3. A coin collector according to claim 2, wherein said means defining a coin return channel includes at least one bounding wall, said swivel plate having an edge movable adjacent and along said bounding wall during said first portion of the full stroke of the return bolt for blocking passage of a coin to said channel inlet.

4. A coin collector according to claim 2, wherein said stop member is dimensioned so that said first portion of the full stroke is long with respect to said remainder of the full stroke.

5. A coin collector according to claim 2, wherein said hinged portion clears said coin return channel substantially completely during said remainder of the full stroke.

6. A coin collector according to claim 2, including a supporting element connected to said swivel plate for engaging and supporting said hinged portion from below.

7. A coin collector according to claim 6, wherein said supporting element is a spring.

8. A coin collector according to claim 2, wherein said stop member comprises a lever movably mounted to said coin return channel defining means having a stop surface for supporting said hinged portion and an inclined face opposite said stop surface engageable by said hinged portion when said swivel plate moves from its coin release position back to its rest position so that said hinged portion deflects said movable lever out of the path of said hinged portion.

9. A coin collector according to claim 2, wherein said hinged portion is pivotally connected to the remainder of said swivel plate at a location closer to a pivotal axis of said swivel plate than to an outer edge of said hinged portion.

10. A coin collector according to claim 2, wherein said means connecting said swivel plate to said return bolt comprise a connecting rod movably mounted to the vending machine having a stop edge, said swivel plate having a pin member connected thereto engageable with said stop edge for transmitting motion of the bolt to said swivel plate to move said swivel plate from its rest position to its coin release position, said swivel plate movable into a coin collecting position, said pin member being moved out of engagement and out of a path of movement of said stop edge with said pivot plate moved to its coin collecting position.

* * * * *